United States Patent [19]

Rhodes

[11] Patent Number: 5,044,385

[45] Date of Patent: Sep. 3, 1991

[54] PONYTAIL HOLDER AND METHOD OF MAKING SAME

[75] Inventor: Deborah Rhodes, New York, N.Y.

[73] Assignee: Nimbus Corp., New York, N.Y.

[21] Appl. No.: 626,451

[22] Filed: Dec. 12, 1990

[51] Int. Cl.[5] ..... A45D 8/34

[52] U.S. Cl. ..... 132/273; 132/275; 2/198

[58] Field of Search ..... 132/200, 273, 274, 275; 2/171, 172, 174, 181, 181.2, 181.4, 181.6, 182.3, 182.7, 198

[56] References Cited

U.S. PATENT DOCUMENTS

| | | | |
|---|---|---|---|
| D. 131,600 | 3/1942 | Holden | 132/273 |
| D. 167,553 | 8/1952 | Behr | 132/275 |
| 712,657 | 11/1902 | Davis | 132/273 |
| 971,519 | 10/1910 | Brannen | 132/273 |
| 2,106,075 | 1/1938 | Tabley | 2/181 |
| 2,495,041 | 1/1950 | Weiss | 2/198 |
| 2,595,657 | 5/1952 | Harmon | 132/273 |
| 2,668,547 | 2/1954 | Wille | 132/273 |
| 2,796,069 | 6/1957 | Mooney, Jr. | 132/273 |
| 2,805,673 | 9/1957 | Solomon | 132/275 |
| 3,031,681 | 5/1962 | Hoeflich | 2/198 |
| 3,138,801 | 6/1964 | Brodsky | 2/174 |
| 3,229,308 | 1/1966 | Jensen | 2/198 |
| 3,301,266 | 1/1967 | Hoffmann | 132/273 |
| 3,611,442 | 10/1971 | Yazaki | 2/174 |
| 4,656,671 | 4/1987 | Manges | 2/174 |

FOREIGN PATENT DOCUMENTS

| | | | |
|---|---|---|---|
| 183519 | 10/1955 | Austria | 132/275 |

*Primary Examiner*—John J. Wilson
*Assistant Examiner*—Frank A. LaViola
*Attorney, Agent, or Firm*—Charles E. Temko

[57] ABSTRACT

An elastic ponytail holding device and method of making the same. The device is fabricated by forming a rectangular piece of flexible material such as cloth longitudinally and stitching the same to form a flattened tube. An elastic band is stitched under tension to the tube. While in tensioned condition, the tube is transversely slitted to form tab-like two ply petals which under contraction of the elastic band present a simulated floral appearance, following which the ends of the elastic band and tube are interconnected to form a resilient loop.

5 Claims, 2 Drawing Sheets

PONYTAIL HOLDER AND METHOD OF MAKING SAME

BACKGROUND OF THE INVENTION

This invention relates generally to the field of hair holding devices, and more particularly to an improved ponytail holder of contractile type adapted to maintain and be supported by a ponytail. Devices of this general type are well known in the art, and the invention lies in specific constructional details and a novel method of manufacture.

The elastic ponytail holder has its origin in a simple flat elastic rubber band which may be doubled upon itself as many times as necessary to secure the hair in place. While fully functional, such an expedient is not aesthetically pleasing, and attempts have been made to provide a device capable of a similar function with a more decorative appearance. A common group of devices include a circular body of elastic material stitched over its length to a decorative piece or plurality of pieces of cloth to suggest a floral display comprising a single blossom. Others attempt to suggest a cloth ruffle somewhat resembling a "leg-of-mutton" sleeve, while still others present a stylized representation of a ribbon.

The representation of a flower or blossom having multiple petals has been particularly difficult for the reason that actual petals are generally of elongated configuration, and are of substantial thickness not readily simulated by a single layer of cloth. Further, in most flowers, the petals are positioned in generally overlapped or staggered relation, again a condition not relatively simulated by a single thickness of cloth. It will be readily appreciated that the cutting or otherwise forming of individual petals and subsequent stitching of the same to the elastic member requires considerable skill, and as a practical matter, such construction is precluded by considerations related to the cost of manufacture.

SUMMARY OF THE INVENTION

Briefly stated, the invention contemplates the provision of an improved device of the class described in which the above mentioned disadvantages have been substantially resolved. To this end, the device is formed by providing one or more generally rectangularly shaped cloth layers which are folded longitudinally and stitched to form elongated tubes. The tube or tubes are then stitched along the longitudinal axis of the same to an elastic planar band while the latter is in stretched condition. While maintaining the band in expanded condition a series of spaced radially inwardly extending cuts are made in the tubes to form simulated two ply petals which are joined at the inner ends thereof to the unsevered portion of the body of each tube. Finally, the tube and band are then interconnected end to end to form a continuous loop. When the device is allowed to contract, the petals on each tube will assume a staggered relation with respect to the petals on the other tube or tubes.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 4:
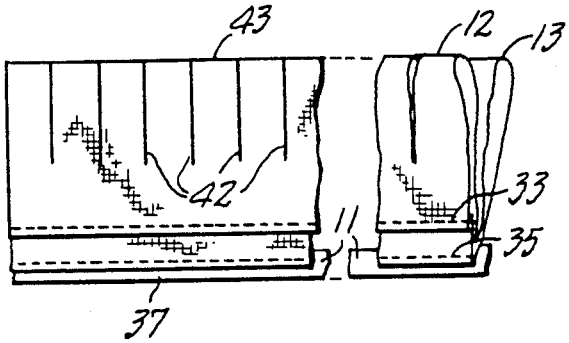
FIG. 4 is an end elevational view as seen from the right hand portion of FIG. 5.

In accordance with the invention, the device, generally indicated by reference character 10, comprises broadly, an elongated planar elastic band 11 and first and second juxtaposed tubular flexible, preferably textile, members 12 and 13 (see FIG. 4).

The band 11 is generally conventional and is bounded by first and second planar surfaces 18 and 19 extending between first and second longitudinal edges 20 and 21. Most conveniently it is approximately ¼" in width.

Figure 2:
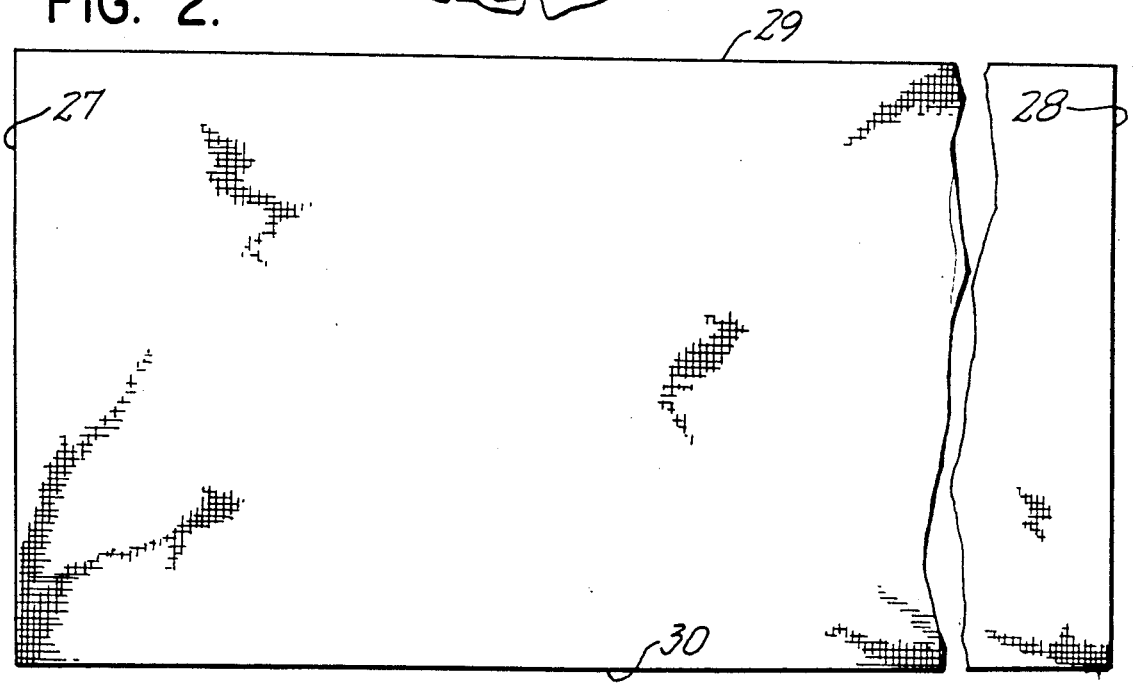
FIG. 2 is a view in elevation of a single planar blank of flexible material in accordance with a first step in the manufacture of the embodiment.

Referring to FIG. 2 in the drawing, the members 12 and 13 are formed from a single blank of material 4½ inches in length and approximately 1½ inches in width. Each blank is bounded by opposed end edges 27 and 28 and longitudinal edges 29 and 30.

Figure 3:
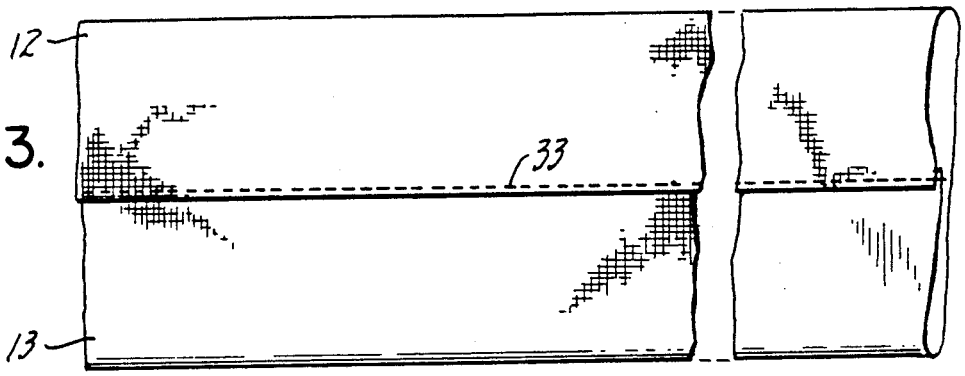
FIG. 3 is a view in elevation showing a second step in the manufacture of the embodiment.

Referring to FIG. 3, as a first step in the manufacture, the blank is folded longitudinally and flattened and stitched along a line 33. As shown in FIG. 4, the tubular members 12 and 13 are juxtaposed and stitched along a line 35 to the band 11 while the latter is in relatively stretched condition as indicated by reference 37. While the structure is in expanded condition, a series of inwardly directed radial cuts 42 are formed in the tubes to form plural two ply petals bounded by interconnected outer ends 43 and non-interconnected ends 44 positioned outwardly of the inner edge of the tubes.

Figure 5:
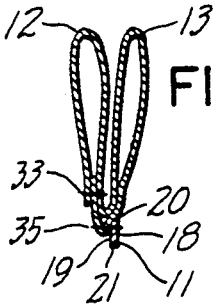
FIG. 5 is a view in elevation showing the cutting of individual petals in the flexible material comprising a third step.
Figure 6:
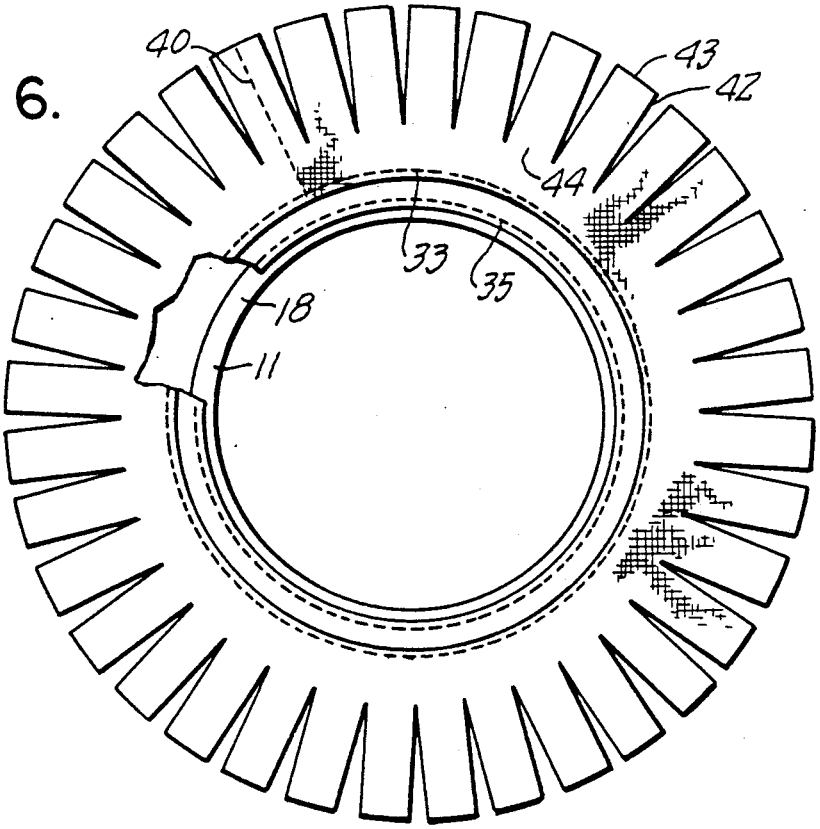
FIG. 6 is a view in elevation showing the interconnection of the free ends of the structure shown in FIG. 5 forming a fourth step to complete manufacture of the device.

Referring to FIG. 6, the free edges of the interconnected structure shown in FIGS. 4 and 5 are then interconnected by a line of stitches 40 to form a pair of endless cloth loops which expand or contract depending upon the condition of the elastic band 11.

Figure 1:
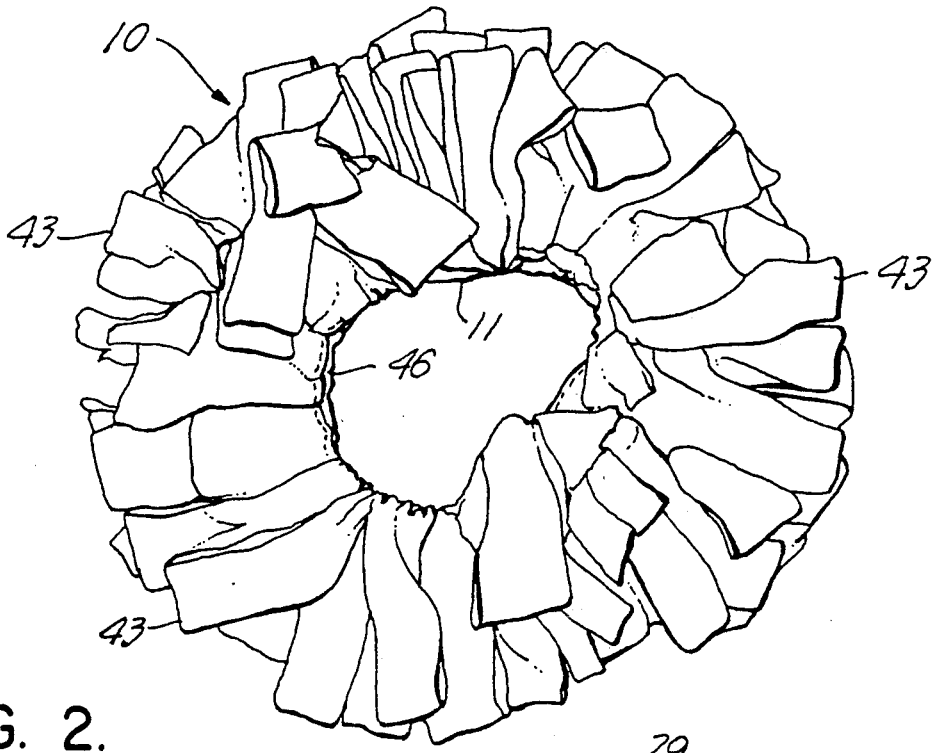
FIG. 1 is a side elevational view of an embodiment of the invention in relatively contracted condition.

When the elastic member 11 is allowed to contract, the device assumes the appearance shown in FIG. 1 including an opening 46 through which the ponytail of a wearer (not shown) extends. Since upon contraction, there is insufficient space to accommodate the petals in overlapped relation, they will assume the random staggered appearance shown in FIG. 1.

It may thus be seen that I have invented novel and highly useful improvements in ponytail hair holding devices and a method of manufacturing same. By use of the above described method, it is possible to fabricate such devices to afford the appearance of a fully blossomed flower with staggered realistically appearing petals of appreciable thickness in mutually staggered relation to a degree heretofore impossible using prior art methods. Only three simple straight line stitching operations are required. The radially inwardly directed cutting operation may be performed either manually or mechanically, and in the case of the latter, manufacturing operations are reduced to a bare minimum. As a consequence, the manufacturing cost of the completed article may be maintained at very reasonable levels, with correspondingly wide public acceptance being possible.

I wish it to be understood that I do not consider the invention to be limited to the precise details of structure shown and set forth in the specification, for obvious modifications will occur to those skilled in the art to which the invention pertains.

I claim:

1. The method of making a ponytail holding device comprising the steps of:

a) providing a length of elongated planar elastic material;

b) providing at least one generally rectangular end of flexible material having a principle longitudinal axis, opposed end edges and parallel longitudinal edges;

c) foldings at at least one band of flexible material along a longitudinal axis, and interconnecting said longitudinal edges to form a flattened elongated tube;

d) longitudinally expanding said elastic member, and while in expanded state interconnecting the same to said at least one band of flexible material adjacent said interconnecting longitudinal edges;

e) while maintaining said band in expanded condition, making a series of radially inwardly directed cuts in said circular loop of material, said cuts extending less than the width of said loop of material to form simulated petals of generally rectangular two ply configuration; and f) interconnecting said end edges of said at least one rectangular band to each other to form a circular loop of material.

2. The method set forth in claim 1, further comprising the step of folding said flattened elongated tube longitudinally to form a pair of tubes before the step of interconnecting said elastic band.

3. An improved ponytail holding device comprising an endless planar elastic band; at least one flattened hollow tube of flexible material having mutually interconnecting end edges and interconnected to said elastic band along the axial length of said tube and band, while said band is in relatively expanded condition; said hollow tube having radially inwardly directed cut edges extending through less than the entire width of said tube to form two ply radially outwardly extending petal simulating members.

4. A ponytail holding device in accordance with claim 3, further comprising a second hollow tube of flexible material interconnected in substantially congruent relation with respect to said at least one tube to said elastic band.

5. A ponytail holding device in accordance with claim 4, further comprising said radially inward cut edges are disposed in mutually staggered relation with respect to said at least one and second hollow tubes, when said elastic band is in relatively contracted condition.

* * * * *